US007893624B2

(12) United States Patent
Huang

(10) Patent No.: US 7,893,624 B2
(45) Date of Patent: Feb. 22, 2011

(54) BACKLIGHT CONTROL CIRCUIT HAVING FREQUENCY SETTING CIRCUIT AND METHOD FOR CONTROLLING LIGHTING OF A LAMP

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 304 days.

(21) Appl. No.: 12/214,176

(22) Filed: Jun. 16, 2008

(65) Prior Publication Data

US 2008/0309248 A1 Dec. 18, 2008

(30) Foreign Application Priority Data

Jun. 15, 2007 (CN) ..... 2007 1 0075051

(51) Int. Cl.
*H01J 61/52* (2006.01)

(52) U.S. Cl. ..... 315/112; 315/117; 315/118

(58) Field of Classification Search ..... 315/291, 315/299, 300, 301, 307, 308, 309, 310, 311, 315/313, 317, 320, 322, 32, 50, 51, 52, 56, 315/58, 71, 112, 117, 118, 209 R, 224, 226, 315/361, 362

See application file for complete search history.

(56) References Cited

U.S. PATENT DOCUMENTS

| | | | |
|---|---|---|---|
| 5,907,742 | A | 5/1999 | Johnson et al. |
| 6,654,268 | B2 | 11/2003 | Choi |
| 2004/0207532 | A1 | 10/2004 | Smithson |
| 2006/0138972 | A1 * | 6/2006 | Hsieh et al. ..... 315/291 |

FOREIGN PATENT DOCUMENTS

JP P2000-350448 A 12/2000

OTHER PUBLICATIONS

Ming-Dong Zhou. Min Jia, Digital Potentiometer and Its Applications, (1st Ed), published by Digitized Periodical in Feb. 28, 2006. See pp. 65-66, Figure 1 and Table 1.

* cited by examiner

*Primary Examiner*—Douglas W Owens
*Assistant Examiner*—Jianzi Chen
(74) *Attorney, Agent, or Firm*—Wei Te Chung

(57) ABSTRACT

An exemplary backlight control circuit includes an inverter, a pulse width modulation (PWM) circuit, and a frequency setting circuit. The inverter is configured to provide an alternating current voltage to a lamp. The PWM circuit is configured to provide a pulse control signal to the inverter. The frequency setting circuit configured to regulate a frequency of the pulse control signal provided by the PWM circuit according to an environment temperature.

9 Claims, 2 Drawing Sheets

| reference temperature (°C) | startup frequency (KHz) | binary instruction |
|---|---|---|
| ..... | ..... | ..... |
| T< -10 | 70 | 11100000 |
| -10 ≤T< 0 | 65 | 11000110 |
| 0 ≤T< 10 | 59 | 10011000 |
| 10 ≤T< 20 | 53 | 11100001 |
| 20 ≤T< 30 | 50 | 11100111 |
| ..... | ..... | ..... |

BACKLIGHT CONTROL CIRCUIT HAVING FREQUENCY SETTING CIRCUIT AND METHOD FOR CONTROLLING LIGHTING OF A LAMP

CROSS-REFERENCE TO RELATED APPLICATION

This application is related to an application by SHUN-MING HUANG entitled BACKLIGHT CONTROL CIRCUIT HAVING FREQUENCY SETTING CIRCUIT AND METHOD FOR CONTROLLING LIGHTING OF A LAMP, filed on the same day as the present application and assigned to the same assignee as the present application.

FIELD OF THE INVENTION

The present invention relates to a backlight control circuit including a frequency setting circuit which is configured to regulate a startup frequency of a lamp, and to a method for controlling lighting of a lamp using the backlight control circuit.

GENERAL BACKGROUND

Liquid crystal displays are commonly used as display devices for compact electronic apparatuses, not only because they provide good quality images but also because they are very thin. Liquid crystal in a liquid crystal display does not emit any light itself. The liquid crystal requires a light source so as to be able to clearly and sharply display text and images. Therefore, a typical liquid crystal display generally requires an accompanying backlight module. If a cold cathode fluorescent lamp (CCFL) is used in a backlight module, the backlight module generally includes a backlight control circuit. The backlight control circuit is configured for converting a direct current voltage to an alternating current voltage to drive the CCFL.

Referring to FIG. 3, a typical backlight control circuit 100 includes a pulse width modulation (PWM) circuit 110, a frequency setting circuit 140, an inverter 120, and a lamp 130. The PWM circuit 110 is configured to generate a pulse control signal, and output the pulse control signal to the inverter 120. The inverter 120 is configured to convert an external direct current voltage to an alternating current voltage to drive the lamp 130 under the control of the pulse control signal. The frequency setting circuit 140 is configured to set a frequency of the pulse control signal outputted by the PWM circuit 110.

The PWM circuit 110 includes a working frequency capacitor terminal 111, a working frequency resistor terminal 112, and a startup frequency resistor terminal 113 for setting a frequency to light the lamp 130.

The frequency setting circuit 140 includes a capacitor 141, a first resistor 142, and a second resistor 143. The capacitor 141 is connected between the working frequency capacitor terminal 111 of the PWM circuit 110 and ground. The first resistor 142 is connected between the working frequency resistor terminal 112 and ground. The second resistor 143 is connected between the working frequency resistor terminal 112 and the startup frequency resistor terminal 113. A capacitance of the capacitor 141 can be 220 picofarads (pF). A resistance of the first resistor 142 can be 52.3 kiloohms (KΩ). A resistance of the second resistor 143 can be 240 kiloohms.

The PWM circuit 110 can be an OZ960 type IC. The frequency of the pulse control signal outputted by the PWM circuit 110 for lighting the lamp is determined by the capacitor 141 and the first and the second resistors 142, 143 of the frequency setting circuit 140. The frequency of the pulse control signal can be calculated according to the following formula (1):

$$f_s = \frac{70 \times 10^4}{C \times R}. \tag{1}$$

In formula (1), "$f_s$" denotes the frequency of the pulse control signal, and a unit of the pulse control signal is kilohertz (KHz). "R" denotes the resistance of the first resistor 142 and the second resistor 143 connected in parallel with the first resistor 142, and a unit of the resistance is kiloohms. "C" denotes a capacitance of the capacitor 141, and a unit of the capacitance is picofarads.

When the backlight control circuit starts to work, a startup frequency for lighting the lamp 130 is a frequency of the alternating current voltage outputted by the inverter 120, and is the same as the frequency of the pulse control signal. In general, because the capacitance of the capacitor 141 and the resistances of the first and second resistors 142, 143 are fixed, the frequency of the alternating current voltage outputted by the inverter 120 and the frequency of the pulse control signal are fixed. Thus, the startup frequency for lighting the lamp 130 is fixed.

However, under different environment temperatures, the lamp 130 has different equivalent resistances which correspond to different optimal startup frequencies. In general, the startup frequency of the lamp 130 increases with a decrease in the environment temperature. The lamp 130 can be lighted up when the lamp 130 is driven with a frequency approximately the same as the optimal startup frequency. When the environment temperature changes to a low temperature, the actual startup frequency of the lamp 130 remains the same and thereby is lower than the optimal startup frequency. Thus it can be difficult light up the lamp 130.

Therefore, a new backlight control circuit that can overcome the above-described problems is desired. What is also desired is a method for controlling lighting of a lamp using such backlight control circuit.

SUMMARY

In an exemplary embodiment, a backlight control circuit includes a lamp, an inverter, a PWM circuit, and a frequency setting circuit. The inverter is configured to provide an alternating current voltage for the lamp. The PWM circuit is configured to provide a pulse control signal to the inverter. The frequency setting circuit is configured to regulate a frequency of the pulse control signal provided by the PWM circuit according to an environment temperature.

Other novel features and advantages will become more apparent from the following detailed description when taken in conjunction with the accompanying drawings.

DETAILED DESCRIPTION OF PREFERRED EMBODIMENTS

Figure 1:
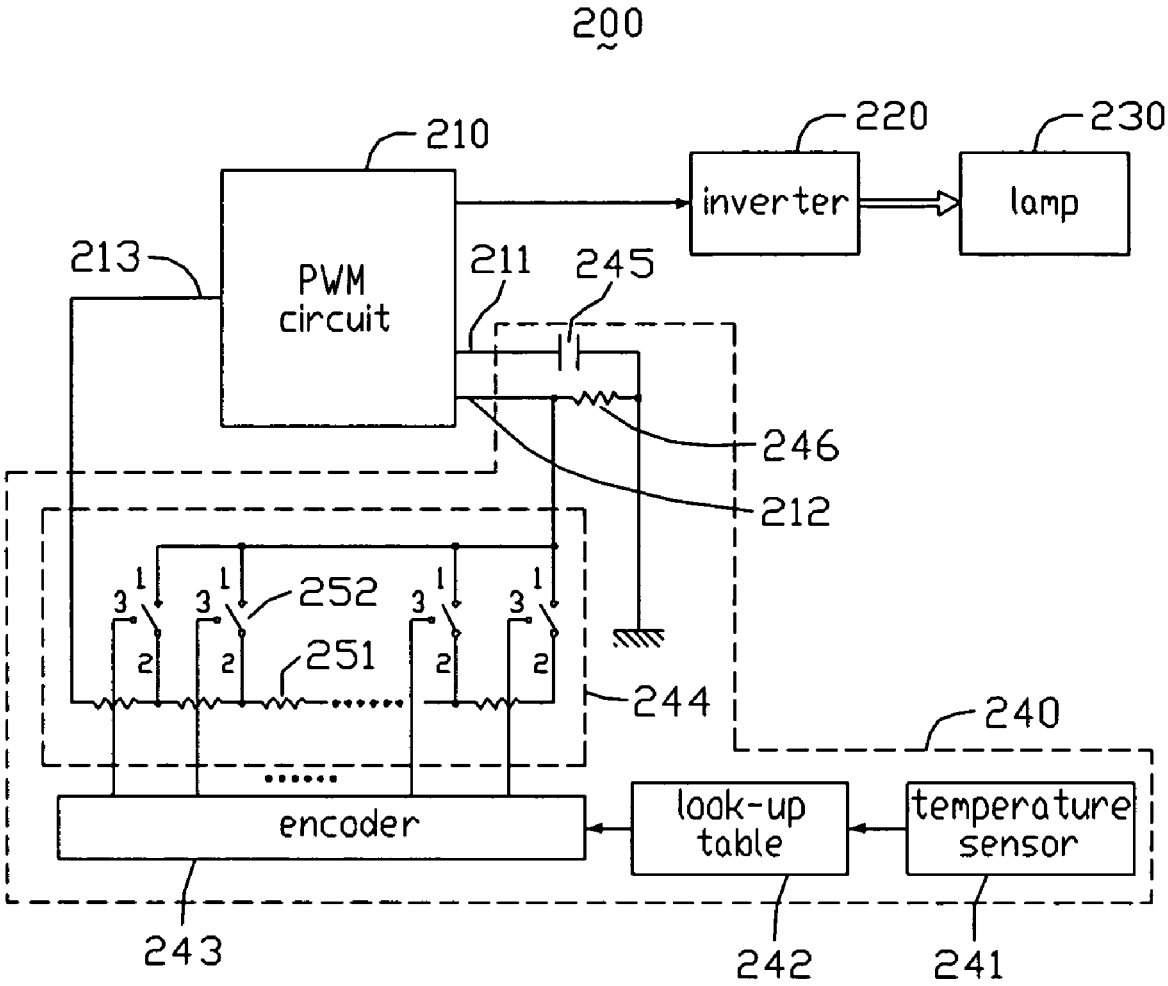
FIG. 1 is essentially an abbreviated diagram of a backlight control circuit according to an exemplary embodiment of the present invention, the backlight control circuit including a look-up table.

Referring to FIG. 1, a backlight control circuit 200 according to an exemplary embodiment of the present invention is shown. The backlight control circuit 200 includes a lamp 230, an inverter 220, a PWM circuit 210, and a frequency setting circuit 240.

The PWM circuit 210 is configured to generate a pulse control signal, and output the pulse control signal to the inverter 220. The inverter 220 is configured to convert an external direct current voltage to an alternating current voltage to drive the lamp 230 under the control of the pulse control signal. The frequency setting circuit 240 is configured to set a frequency of the pulse control signal outputted by the PWM circuit 210 according to an environment temperature. In this description, the environment temperature is referred to as ambient temperature.

The PWM circuit 210 includes a working frequency capacitor terminal 211, a working frequency resistor terminal 212, and a startup frequency resistor terminal 213.

The frequency setting circuit 240 includes a temperature sensor 241, a look-up table 242, an encoder 243, a digitally adjustable resistor 244, a capacitor 245, and a first resistor 246. The digitally adjustable resistor 244 includes a plurality of second resistors 251 connected in series, and a plurality of switches 252. Each switch 252 includes a first terminal 1, a second terminal 2, and a control terminal 3 configured to control whether the first and second terminals are electrically connected or disconnected.

The capacitor 245 is connected between the working frequency capacitor terminal 211 of the PWM circuit 210 and ground. The first resistor 246 is connected between the working frequency resistor terminal 212 of the PWM circuit 210 and ground. The second resistors 251 form a series branch which is connected between the second terminal 2 of one of the switches 252 and the startup frequency resistor terminal 213. The first terminals 1 of all the switches 252 are connected to the working frequency resistor terminal 212 of the PWM circuit 210. The control terminals 3 of all the switches 252 are connected to output terminals (not labeled) of the encoder 243 respectively. The second terminals 2 of all the switches 252 (excluding the above-mentioned "one of the switches 252") are connected to nodes between adjacent second resistors 251 respectively.

Figures 2, 3:
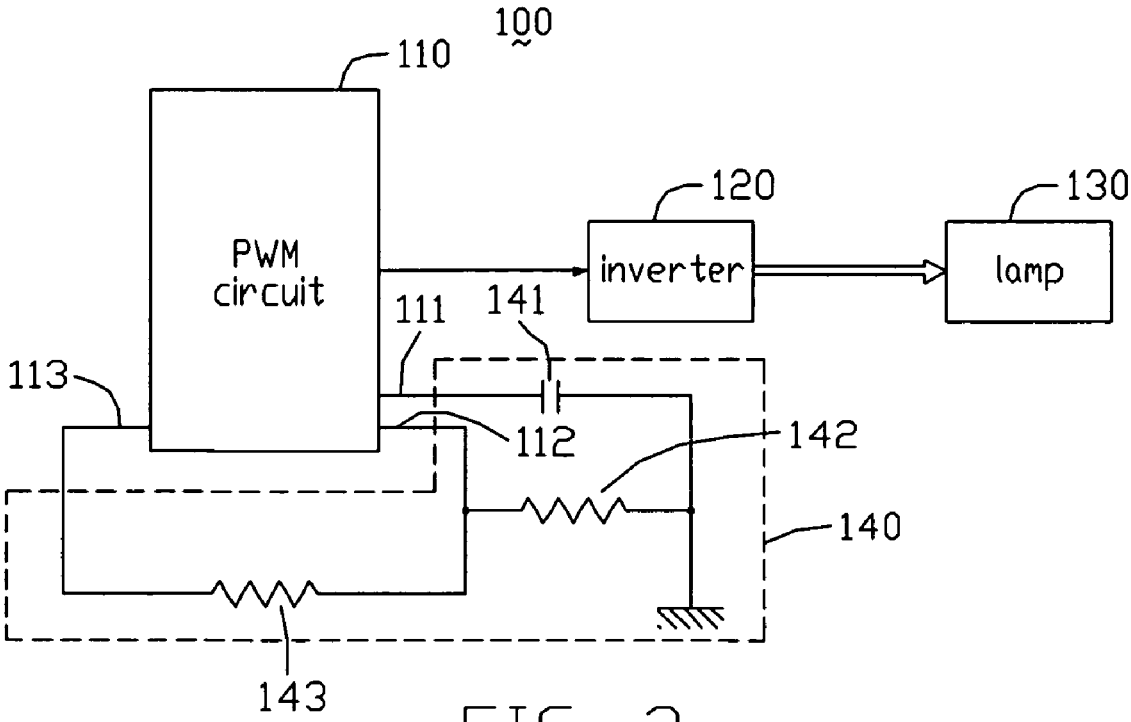
FIG. 3 (RELATED ART)
FIG. 2 is a schematic view of part of the look-up table of FIG. 1.
FIG. 3 is essentially a diagram of a conventional backlight control circuit.

Referring also to FIG. 2, the look-up table 242 is schematically shown. The look-up table 242 includes a plurality of temperature values, a plurality of optimal startup frequencies corresponding to the temperature values respectively, and a plurality of binary instructions corresponding to the startup frequencies respectively. The look-up table 242 is configured to provide searching of a binary instruction according to a reference temperature outputted by the temperature sensor 241, and to provide outputting of the binary instruction to the encoder 243. The encoder 243 is configured to encode the binary instruction, and regulate a resistance of the digitally adjustable resistor 244. In the illustrated embodiment, reference temperatures in the look-up table 242 are grouped in a series of ranges, with each range spanning 10° C.

The temperature sensor 241 is disposed adjacent to the lamp 230. The temperature sensor 241 is configured to sense the ambient temperature, and output a reference temperature to the look-up table 242 according to the ambient temperature.

The lamp 230 can be a CCFL. The PWM circuit 210 can be an OZ960 type IC. A capacitance of the capacitor 245 can be 220 picofarads. A resistance of the first resistor 246 can be 52.3 kiloohms.

An exemplary method for controlling lighting of a lamp using the backlight control circuit is as follows. When the backlight control circuit 200 starts to work, the temperature sensor 241 senses the ambient temperature, and outputs a reference temperature to the look-up table 242. The look-up table 242 provides searching of a binary instruction according to the reference temperature, and provides outputting of the binary instruction to the encoder 243. In one embodiment, the frequency setting circuit 240 performs such searching and outputting. The encoder 243 encodes the binary instruction, and controls states of the switches 252 of the digitally adjustable resistor 244 in order to regulate a resistance of the digitally adjustable resistor 244. The PWM circuit 210 outputs a pulse control signal to the inverter 220. A frequency of the pulse control signal is determined by the resistance of the first resistor 246, the resistance of the digitally adjustable resistor 244, and a capacitance of the capacitor 245. The inverter 220 outputs an alternating current to drive the lamp 230. A frequency of the alternating current is a startup frequency of the lamp 230.

In summary, the backlight control circuit 200 includes the frequency setting circuit 240, which can regulate the frequency of the pulse control signal according to the ambient temperature. Even though the ambient temperature changes, the startup frequency of the lamp 230 does not substantially deviate from an optimal startup frequency. Thus, the lamp 230 can easily be lighted up even the ambient temperature is very low.

Further or alternative embodiments may include the following. In one example, the look-up table 242 can include individual reference temperatures each of which is an integer, together with corresponding startup frequencies and corresponding binary instructions. In such case, the temperature sensor 241 can directly output an ambient temperature value in the form of an integer, and the reference temperature column in the look-up table 242 can instead be an ambient temperature column. Furthermore, the startup frequency of the lamp 230 can be regulated even more precisely.

It is to be further understood that even though numerous characteristics and advantages of the present embodiments have been set out in the foregoing description, together with details of the structures and functions of the embodiments, the disclosure is illustrative only; and that changes may be made in detail, especially in matters of shape, size and arrangement of parts within the principles of the invention to the full extent indicated by the broad general meaning of the terms in which the appended claims are expressed.

What is claimed is:

1. A backlight control circuit comprising:

an inverter configured to provide an alternating current voltage to a lamp;

a pulse width modulation (PWM) circuit configured to provide a pulse control signal to the inverter; and a frequency setting circuit configured to regulate a frequency of the pulse control signal provided by the PWM circuit according to an environment temperature;

wherein the frequency setting circuit comprises an adjustable resistor, a temperature sensor configured to sense the environment temperature, a look-up table and an encoder, the look-up table comprises a plurality of environment temperature values and a plurality of binary instructions corresponding to the environment temperature values, the frequency setting circuit searches the look-up table for a binary instruction corresponding to the environment temperature and output the binary instruction to the encoder, the encoder encodes the binary instruction, and the frequency setting circuit is further configured to regulate a resistance of the adjustable resistor according to the encoded binary instruction.

2. The backlight control circuit of claim 1, wherein the adjustable resistor comprises a plurality of resistors connected in series and a plurality of switches, each switch comprising a first terminal, a second terminal, and a control terminal, the resistors forming a series branch which is connected between the second terminal of one of the switches and a startup frequency resistor terminal of the PWM, the second terminals of the other switches being connected to nodes between adjacent resistors respectively, and the control terminals of all the switches being connected to output terminals of the encoder respectively.

3. The backlight control circuit of claim 2, wherein the PWM circuit comprises a working frequency capacitor terminal, a working frequency resistor terminal, and the startup frequency resistor terminal.

4. The backlight control circuit of claim 3, wherein the first terminals of all switches are connected to the working frequency resistor terminal of the PWM circuit.

5. The backlight control circuit of claim 4, wherein the frequency setting circuit further comprises a capacitor connected between the working frequency capacitor terminal of the PWM circuit and ground, and a first resistor connected between the working frequency resistor terminal of the PWM circuit and ground.

6. The backlight control circuit of claim 5, wherein a capacitance of the capacitor is approximately 220 picofarads, and a resistance of the first resistor is approximately 52.3 kiloohms.

7. The backlight control circuit of claim 1, wherein the lamp is connected to the inverter.

8. A method for controlling lighting of a lamp using the backlight control circuit of claim 1, the method comprising:

sensing an environment temperature;

outputting the sensed temperature to a look-up table;

setting a frequency of a pulse control signal provided by the PWM circuit according to the environment temperature, wherein setting the frequency of the pulse control signal comprises: the look-up table providing a binary instruction corresponding to the sensed environment temperature, and outputting the binary instruction to an encoder; the encoder encoding the binary instruction and setting a resistance of an adjustable resistor; and the PWM circuit outputting the pulse control signal to the inverter according to the resistance of the adjustable resistor; and the inverter outputting an alternating current voltage to the lamp according to the frequency of the pulse control signal.

9. The method of claim 8, wherein the adjustable resistor comprises a plurality of resistors connected in series and a plurality of switches, and the encoder switches on or switches off the switches according to the binary instruction thereby adjusting the resistance of the adjustable resistor.

* * * * *